US007246412B2

(12) United States Patent
Pacholke

(10) Patent No.: US 7,246,412 B2
(45) Date of Patent: Jul. 24, 2007

(54) ADJUSTABLE HANGER HINGE

(75) Inventor: Glen Douglas Pacholke, Eatons Hill (AU)

(73) Assignee: Centor Products Pty, Ltd. (AU)

( * ) Notice: Subject to any disclaimer, the term of this patent is extended or adjusted under 35 U.S.C. 154(b) by 365 days.

(21) Appl. No.: 10/853,935

(22) Filed: May 25, 2004

(65) Prior Publication Data

US 2006/0107490 A1 May 25, 2006

(30) Foreign Application Priority Data

May 29, 2003 (AU) ..... 2003902693

(51) Int. Cl.
*E05D 7/10* (2006.01)

(52) U.S. Cl. ..... 16/264; 16/87 R

(58) Field of Classification Search ..... 16/264, 16/234, 87 R, 87.2, 90, 91, 93 R, 105, 106, 16/107, 102, 97, 380, 381; 403/78, 79, 109.4; 160/196.1, 199; 411/432, 418, 316–318, 411/223, 224, 227, 228

See application file for complete search history.

(56) References Cited

U.S. PATENT DOCUMENTS

| | | | | | |
|---|---|---|---|---|---|
| 778,107 | A * | 12/1904 | Burks | 411/243 |
| 1,192,966 | A * | 8/1916 | Willard | 16/105 |
| 1,587,397 | A * | 6/1926 | Menard | 411/209 |
| 1,821,697 | A * | 9/1931 | Ferris | 16/97 |
| 2,994,099 | A * | 8/1961 | Richards | 16/105 |
| 3,193,870 | A * | 7/1965 | McNinch | 16/97 |
| 4,991,257 | A * | 2/1991 | Eutebach | 16/87 R |
| 5,090,171 | A * | 2/1992 | Kano et al. | 52/243.1 |
| 5,180,265 | A * | 1/1993 | Wiese | 411/150 |
| 2001/0011583 | A1 * | 8/2001 | Spork | 160/199 |

FOREIGN PATENT DOCUMENTS

| | | |
|---|---|---|
| GB | 2265197 | 9/1993 |

* cited by examiner

*Primary Examiner*—Chuck Y. Mah
(74) *Attorney, Agent, or Firm*—Wells St. John P.S.

(57) ABSTRACT

A hanger hinge is used to suspend panels of a folding door or window from an overhead track. The hanger hinge has a hanger bolt with an externally threaded lower end on which a nut is threaded by a tool. The nut is located within a sleeve which engages the bolt to prevent relative rotation between the sleeve and the bolt. At least one hinge leaf is pivotally mounted on the hanger bolt and supported on the sleeve. Each hinge leaf is adapted to be fixed to a respective panel, and the position of the panel(s) is dependent on the extent to which the nut is threaded onto the hanger bolt. A key clip is used to lock the nut rotationally relative to the sleeve, so that the nut cannot rotate relative to the hanger bolt. The key clip is automatically disengaged when the tool is inserted in the nut, to permit the nut to turn relative to the bolt.

10 Claims, 6 Drawing Sheets

ADJUSTABLE HANGER HINGE

TECHNICAL FIELD

This invention relates to an adjustable hanger hinge for a folding door, window or similar closure. In particular, the invention is directed to an adjustable hanger hinge having a lockable height-adjusting nut.

BACKGROUND OF THE INVENTION

A hanger hinge is used to suspend a hinged panel, or a pair of hinged panels, from an overhead horizontal track while permitting the panels to pivot about a vertical hinge axis. Typically, the panels are panels of a folding door, window or similar closure. If the hanger hinge is used to suspend the end panel of a series of panels, it normally has one hinge leaf fixed to that panel. If the hanger hinge is an intermediate hanger used to suspend a pair of adjacent panels, it has a pair of hinge leaves, each fixed to a respective one of the pair of adjacent panels.

Throughout this specification, where the context permits, the term "panel" is intended to refer to a generally planar closure component of a folding door, window, shutter, screen or like closure. The invention will be described with particular reference to its application to panels of a folding door, but the scope of the invention is not limited thereto.

Typically, each hanger hinge (except the hanger hinge nearest the jamb) depends from a respective wheeled carriage which rides along the track. The combination of each hanger hinge and its carriage forms a carrier hinge assembly. An example of a known carrier hinge assembly is illustrated in our Australian Patent No. 726943.

A hanger hinge typically comprises an upright hanger bolt which serves as a hinge pin for the hinge leaf or leaves pivotally mounted thereon. The bottom end of the bolt is threaded to receive a nut thereon. The hinge leaves, which are axially slideable along the hanger bolt, rest upon the nut and are supported thereon. The position of the nut on the hanger bolt therefore determines the position of the hinge leaves relative to both the hanger bolt and the track from which the hanger bolt is suspended. Since the hinge leaves are fixed to the panels in use, the height of the panels can be adjusted by rotating the nut to vary its position along the threaded end of the hanger bolt.

Height adjustment of the panels is usually required from time to time to correct out-of-square movements of the panels and to prevent the door panels from sticking, or otherwise to facilitate smooth movement of the door panels. It is important to ensure that once the hanger hinge has been properly adjusted, it does not lose its adjustment, i.e. that there is no undue rotation of the height-adjusting nut.

It has been found that with conventional hanger hinges, repeated opening and closing of the panels can result in rotation of the nut, and hence loss of adjustment.

Hitherto, a second (locking) nut has been used on the hanger bolt to lock the height-adjusting nut in position. However, such locking nut arrangements are not always effective. Two spanners are usually required to adjust the height of the panels, and due to the positioning of the nuts in close proximity to the panels, damage may be caused to the panels through spanner slippage. Moreover, the nuts are not aesthetically pleasing.

Our U.S. Pat. No. 6,618,900 discloses a lockable carrier hinge assembly in which height adjustment is achieved by threading the hanger bolt into the carriage. The hanger bolt has a fixed nut or head at its bottom end. Once adjusted, the hanger bolt is locked to a hinge leaf, to prevent relative rotation therebetween.

Although the lockable carrier hinge assembly of U.S. Pat. No. 6,618,900 has been found to be satisfactory for most commercial and residential applications, it may not be the optimum design for suspending large and heavy door panels.

It is an aim of this invention to provide an adjustable hanger hinge which overcomes or ameliorates one or more disadvantages of the prior art, or which at least provides the consumer with a useful choice.

SUMMARY OF THE INVENTION

In one broad form, the invention provides a hanger hinge for a folding door, window or similar closure having one or more panels. The hanger hinge comprises a hanger bolt having an externally threaded lower end; a nut member adapted to be threaded onto the threaded end of the hanger bolt; and a sleeve member having a bore dimensioned to receive the nut member at least partially therein, the sleeve member being supported by the nut member in use and operatively engaging the hanger bolt to prevent relative rotation between the sleeve member and the hanger bolt.

At least one hinge leaf is pivotally mounted on the hanger bolt, which serves as a hinge pin. In use, the hinge leaf is fixed to a respective panel. The operative position of the hinge leaf is dependent on the extent to which the nut member is threaded onto the hanger bolt. Typically, the hinge leaf is supported by the sleeve member, which in turn, rests on the nut member threaded on the bolt. As the nut is threaded up and down the bolt, the position of the hinge leaf, and hence the height of the panel to which the leaf is fixed, varies up and down. Thus the height of the panel can be adjusted by rotating the nut member.

The hanger hinge also includes a mechanism for releasably locking the nut member rotationally relative to the sleeve member. Since the sleeve member is itself locked rotationally relative to the hanger bolt, the nut member is thereby locked rotationally relative to the hanger bolt. The mechanism can be disengaged to free the nut member to be rotated relative to the hanger bolt and thereby adjust the position or height of the panel(s). Once the position or height is adjusted, the locking mechanism is re-engaged to prevent undue loss of adjustment.

The nut member is typically a tubular nut having a socket on its underside for receiving an adjusting tool, such as an Allen key or screwdriver.

Preferably, the locking mechanism is a mechanical key, such as a spring clip, which is automatically disengaged when the adjusting tool is inserted into the nut. That is, when the adjusting tool is inserted into the nut, the spring clip no longer keys the nut to the sleeve member.

When the adjusting tool is removed, the spring clip again keys the nut to the sleeve member, or at least limits relative rotation between them, and as the sleeve member is rotationally locked to the bolt, the nut is therefore prevented from losing adjustment.

In one embodiment, the nut member has at least one axial rebate in its lower end and an annular groove on its exterior intermediate its ends. The sleeve member has an axial keyway in its inner wall at its lower end and an annular groove in its inner wall intermediate its ends, the annular grooves being radially opposed in use. The spring clip is operatively located in a composite space formed by the opposed annular grooves, and has an arm located in the axial keyway and resiliently engaging the axial rebate on the nut member. The arm is deflected out of engagement with the axial rebate when a tool is inserted in the nut member, to thereby permit the nut member to rotate relative to the sleeve member.

Preferably, the hanger hinge includes a second key member for keying the hanger bolt to the hinge leaf, to thereby prevent relative rotation between the bolt and the hinge leaf. In this manner, since the sleeve member is rotationally locked to the bolt, the sleeve member is also fixed rotationally relative to the panel. When the nut member is freed, it can be rotated in a single-handed operation as it is not necessary to hold the sleeve (and hanger bolt) against rotation.

The hanger bolt suitably has a rebate portion thereon. The second key member is operatively located between the rebate portion of the hanger bolt and the hinge leaf, and engages the hinge leaf to thereby mechanically lock the hinge leaf against rotation relative to the hanger bolt.

Advantageously, the second key member is fixed to the sleeve member.

In another form, the invention provides a nut assembly for use on a hanger hinge having a depending member with a threaded lower end, the nut assembly comprising a nut member adapted to be threaded onto the lower end of the depending member; a sleeve member having a bore dimensioned to receive the nut member therein, the sleeve member being engageable with the depending member in a rotationally locking relationship; and a locking device for releasably locking the nut member rotationally relative to the sleeve member.

In order that the invention may be more fully understood and put into practice, a preferred embodiment thereof will now be described with reference to the accompanying drawings.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
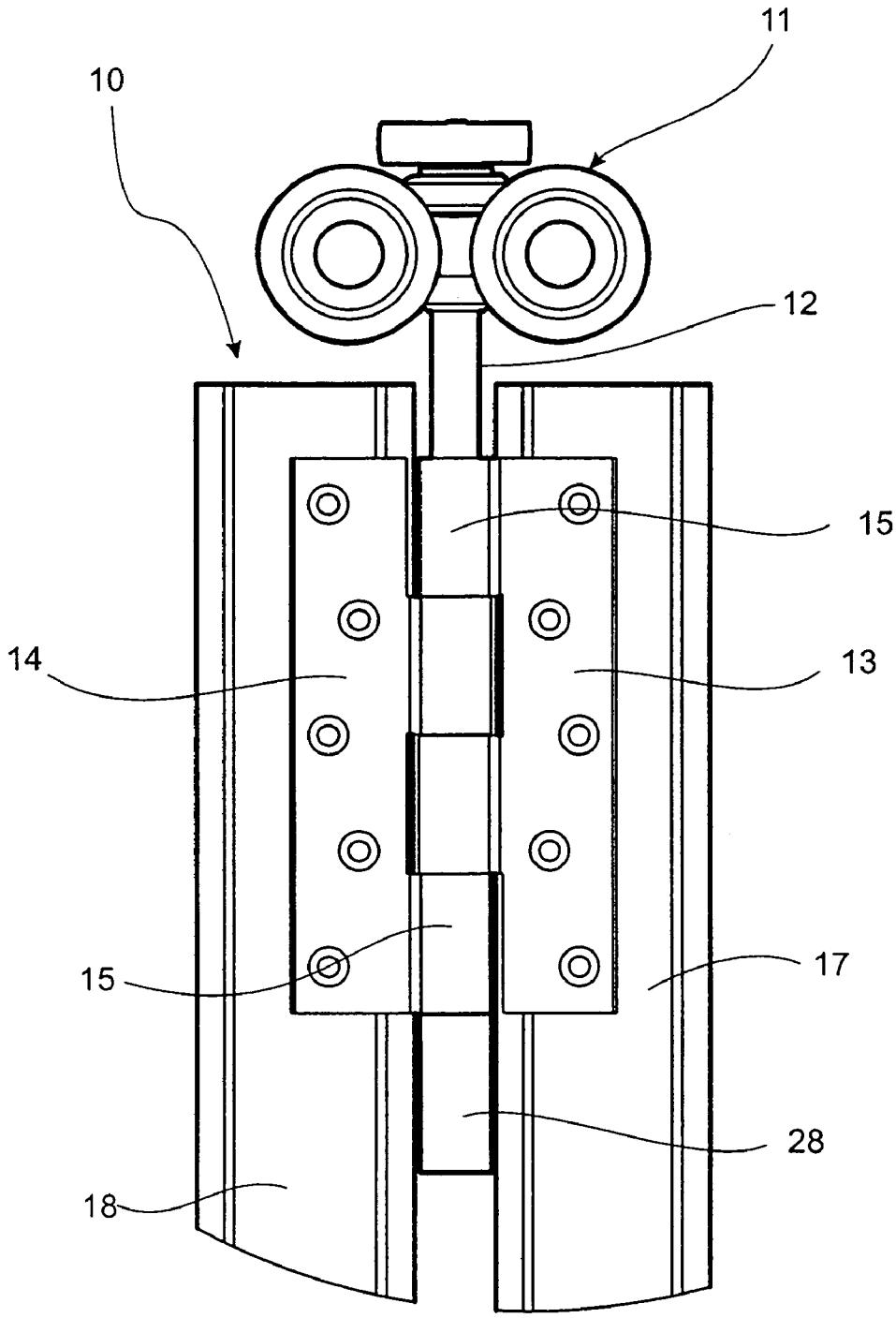
FIG. 1 is a front elevation of a hanger hinge according to one embodiment of the invention, in use.

As shown in FIG. 1, a hanger hinge 10 is suspended from a carriage 11 to form an intermediate carrier for a folding door, window or similar closure. The hanger hinge 10 comprises a hanger bolt 12 having its upper end fixed or otherwise connected to the carriage 11 and depending therefrom. The hanger bolt 12 serves as a hinge pin for a pair of hinge leaves 13, 14. The hinge leaves 13, 14 have interleaved knuckle portions 15 each having a bore 16 dimensioned to receive the hanger bolt 12 in a close sliding fit.

Each hinge leaf 13, 14 is fixed by screws to an edge face of a respective panel 17, 18 of the folding door, window or similar closure. Alternatively, the hinge leaves may form a strap hinge which is face fixed to the panels. If the hanger hinge is used on an end panel, it normally has only one hinge leaf fixed to that end panel.

Figure 2:
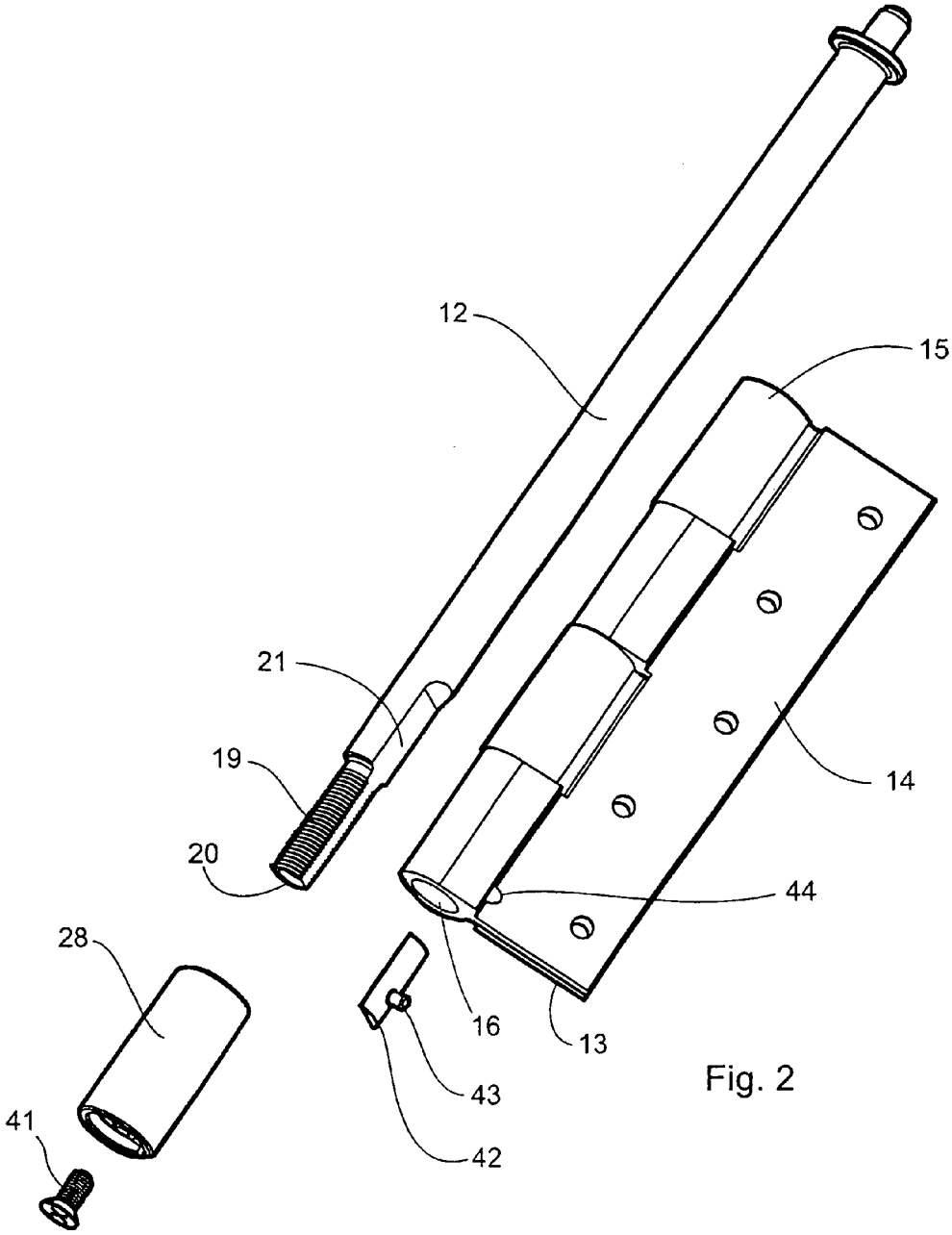
FIG. 2 is a perspective view of the components of the hanger hinge of FIG. 1 when disassembled.
Figure 3:
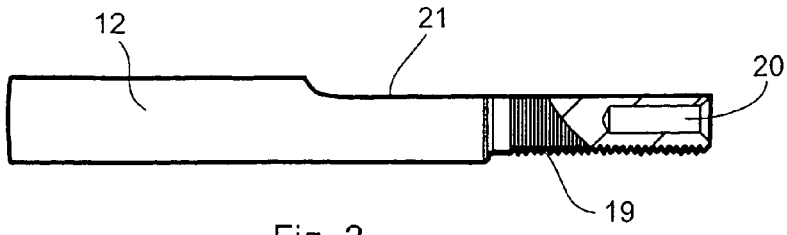
FIG. 3 is a part sectional side elevation of the bottom portion of the hanger bolt of the hanger hinge of FIG. 1.

As can be seen from FIGS. 2 and 3, the hanger bolt 12 has a threaded lower end 19 having a short threaded bore 20 therein. The bottom portion of the hanger bolt 12 also has a chord portion removed to form a flat surface 21.

Figure 4:
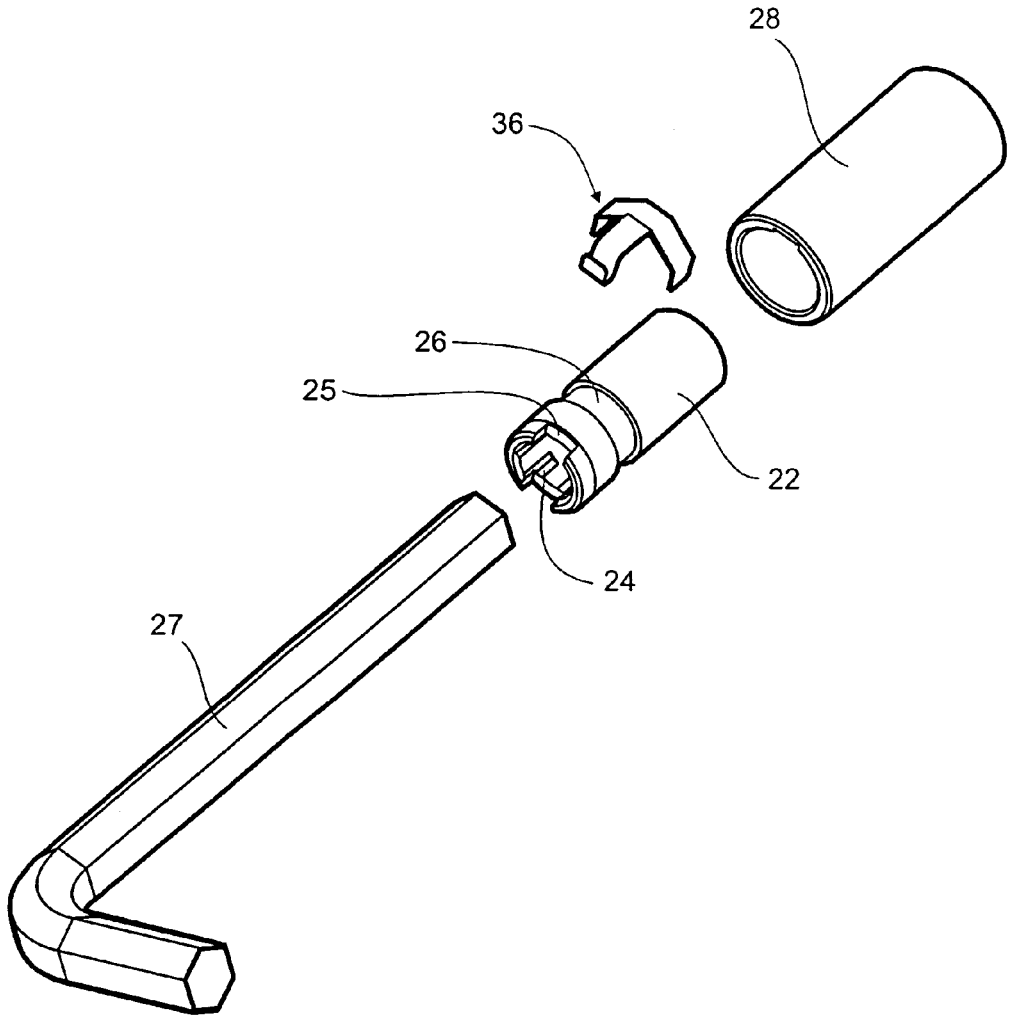
FIG. 4 is an exploded perspective view of the nut and sleeve assembly of the hanger hinge of FIG. 1, with adjustment tool.
Figure 6:
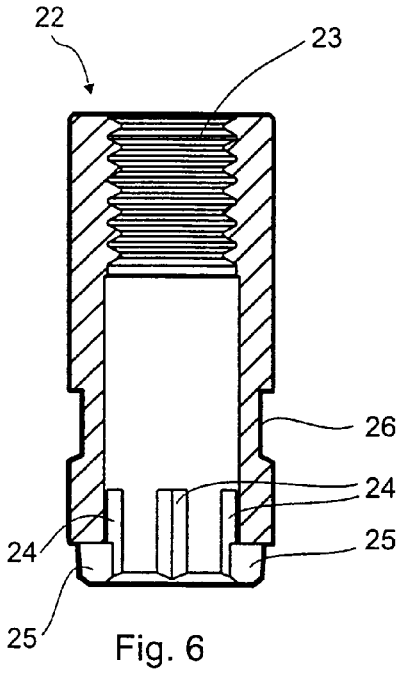
FIG. 6 is a sectional view of the adjusting nut of FIG. 5 along A-A.
Figure 5:
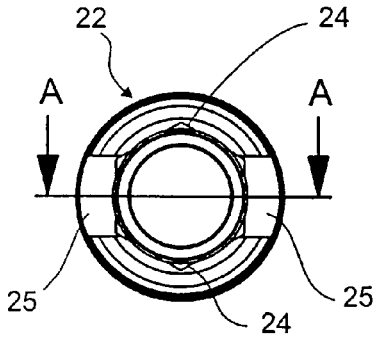
FIG. 5 is an underside view of the adjusting nut of the hanger hinge of FIG. 1.

A nut member in the form of a tubular nut 22 (shown in more detail in FIGS. 4 to 6) is adapted to be threaded onto the hanger bolt 12. The upper end 23 of the tubular nut 22 is internally threaded, for threading onto the end 19 of the hanger bolt. The opposite end of the nut 22 has angular or chord-like rebates 24 machined or otherwise formed in its internal surface, to form a socket having a hexagonal outline. The socket is adapted to receive an adjustment tool, such as an Allen key 27 shown in FIG. 4.

The socket end of the tubular nut 22 has a pair of diametrically opposed, axial rebate portions 25. Intermediate its ends, the tubular nut 22 also has a radially rebated annular portion on its exterior, which forms a neck 26 of reduced diameter.

Figure 8:
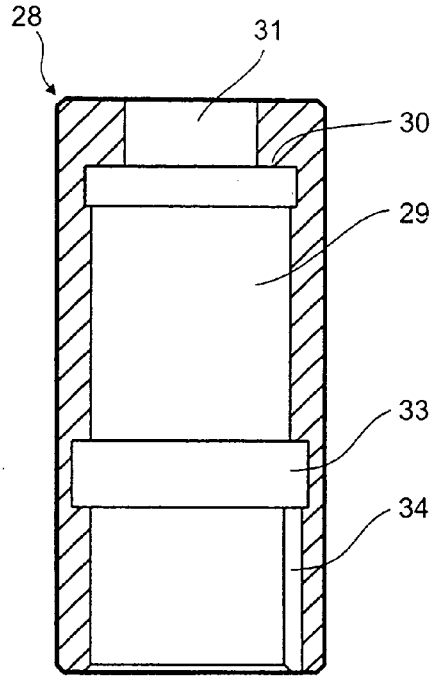
FIG. 8 is a sectional view of the sleeve of FIG. 7 along E-E.
Figure 7:
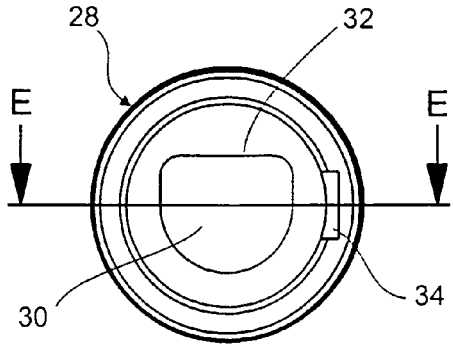
FIG. 7 is an underside view of the sleeve of the hanger of FIG. 1.

The adjustable hanger hinge 10 also includes a sleeve member in the form of a generally tubular sleeve 28, shown in more detail in FIGS. 7 and 8. The sleeve 28 has a bore 29 dimensioned to receive the tubular nut 22 therein in a close sliding fit. The bottom end of the sleeve 28 is open, but its upper end is partially closed by a top end wall 30 having an aperture 31. The aperture 31 is generally D-shaped with a flat side 32, and is dimensioned to receive therein the bottom portion of the hanger bolt 12 having the flat surface 21.

The sleeve 28 also has an annular groove 33 formed on its inner surface, intermediate its ends. An axial keyway 34 is formed in the inner wall of the sleeve 28, and extends from the open end of the sleeve to the angular groove 33, as illustrated in FIG. 8.

Figure 10:
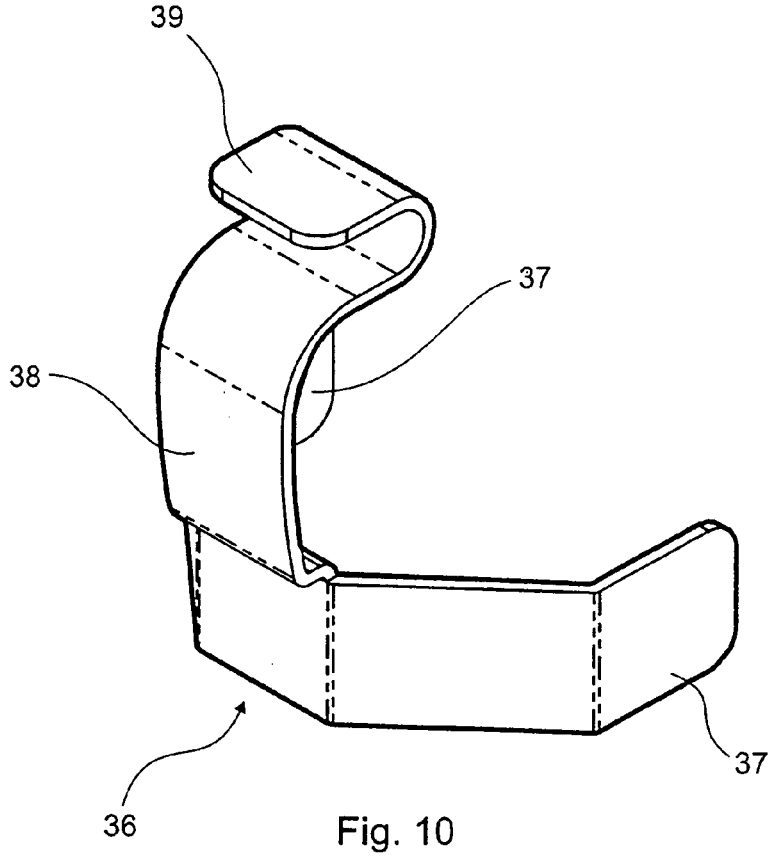
FIG. 10 is a perspective view of the locking key of FIG. 9.

The hanger hinge includes a key 36 for insertion between the nut 22 and the sleeve 28. The key 36 is illustrated in FIG. 10 and is made from a durable resilient material, such as spring steel. In the preferred embodiment, the key 36 is in the form of a spring clip having a pair of arms 37 defining a generally semicircular shape, and a third arm 38 extending orthogonally to the arms 37. The third arm 38 has a rounded nose 39 at its free end.

Figure 9:
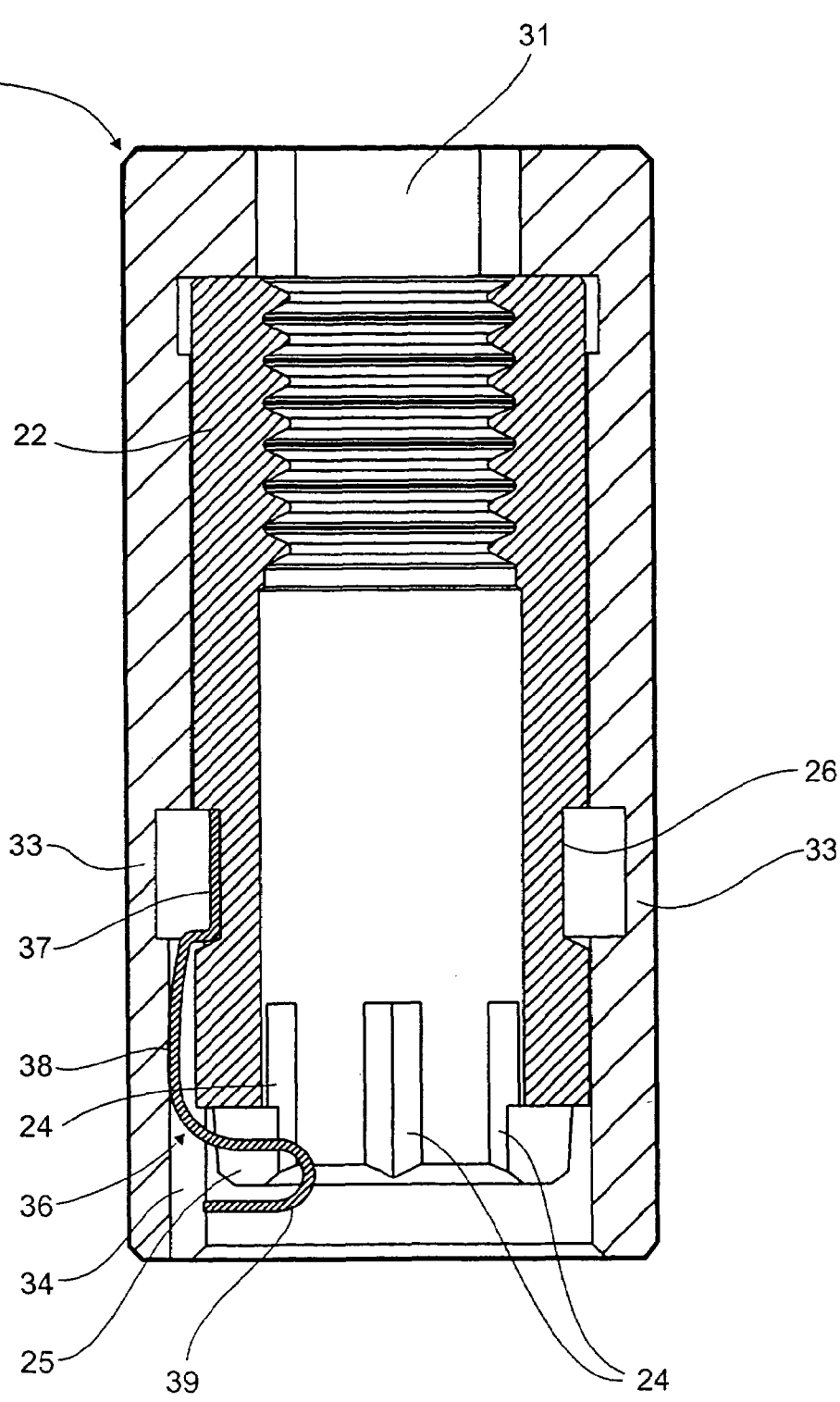
FIG. 9 is a sectional elevation of the nut and sleeve assembly of the hanger hinge of FIG. 1 with locking key.

In use, the nut 22, sleeve 28 and key 36 are assembled as shown in FIG. 9 before threading onto the hanger bolt 12. The key 36 is first applied onto the neck portion 26 of the tubular nut 22, so that its arms 37 grasp the neck portion and locate within the outer diameter of the tubular nut 22. The key 36 is angularly orientated so that its third arm 38 locates in an axial rebate 25, with its nose portion 39 extending into the bore of the tubular nut 22. The nut 22 and key 36 are then orientated so that the arm 38 is aligned with the keyway 34 in the sleeve 28, and the nut 22 is pushed into the bore 29 of the sleeve 28 until the upper end of the nut 22 abuts the end wall 30 of the sleeve 28.

In this position, the neck portion 26 of the nut 22 is radially aligned with the annular groove 33 in the sleeve 28, to form a composite angular cavity in which the arms 37 of the key 36 are captively held. It is to be noted that the third arm 38 of the key 36 locates in both the keyway 34 in sleeve 28 and the rebate 25 in nut 22, thereby locking the nut 22 rotationally to the sleeve 28. That is, when the key 36 is in the position shown in FIG. 9, it prevents relative rotation between the nut 22 and sleeve 28.

The nut and sleeve assembly is then inserted onto the lower end of the hanger bolt 12. To do so, the sleeve must be orientated so that the flat portion 32 of the aperture 31 registers with the flat surface 21 of the hanger bolt 12. It will be apparent that when the sleeve 28 is inserted onto the bottom end of the hanger bolt 12, it will be locked rotationally relative to the hanger bolt due to the engagement of the flat portion 21 with the flat surface 32 of the irregular aperture 31. Since the nut 22 is also locked rotationally relative to the sleeve 28 by the key 36, the nut 22 must be unlocked from the sleeve to enable it to be threaded onto the threaded end 19 of the hanger bolt. This is achieved automatically, due to the shape of the key 36.

When the Allen key 27 is inserted into the socket 24 formed in the lower end of the nut 22, it deflects the nose portion 39 of the spring arm 38 radially outwardly, thereby displacing the arm 38 out of the rebate 25. This frees the nut 22 to rotate relative to the sleeve. With the sleeve 28 held against rotation, e.g. by hand or with a pair of pliers, the Allen key 27 is used to rotate the nut 22 and thread it onto the lower end of the hanger bolt 12. Once the Allen key is removed, the nose portion 39 of the arm 38 will spring back under its own resilience. The nut 22 may be turned so that the nose portion 39 locates in one of the rebates 25, or if not, any subsequent operational relative rotation between the nut and sleeve of less than 180° (typically equivalent to approximately 1 mm pitch) will cause the nose portion 39 to automatically lock in a rebate 25, and again lock the nut 22 to the sleeve 28.

In use, the hinge leaves 13, 14 rest upon the top of the sleeve 28 which, in turn, rests on the nut 22 threaded on the hanger bolt. The weight of the panels borne by the sleeve 28 and nut 22 is transferred to the carriage 11 by the hanger bolt 12. The position of the hinge leaves 13, 14 relative to the hanger bolt 12, and hence the height of the panels 17, 18, is dependant upon the position of the sleeve 28, and hence the position of the nut 22 on the hanger bolt 12.

To adjust the height of the panels 17, 18, the Allen key 27 is inserted into the hexagonal socket 24 in the bottom end of the nut 22, automatically displacing the nose portion 39 and its arm 38, and freeing the nut 22 to rotate relative to the sleeve 28. With the sleeve 28 held against rotation, the nut is rotated in either direction to obtain the desired height adjustment. Upon withdrawal of the Allen key 27, the arm 38 of the key 36 automatically locks the nut 22 relative to the sleeve 28 (and hence the hanger bolt 12), or at least prevents relative rotation between them greater than 180°.

As a safeguard, a wide headed screw 41 (FIG. 2) may be inserted through the bore of the nut 22 and threaded into the bore 20 in the bottom end of the hanger bolt 12. The screw 41 will prevent the nut 22 from detaching completely from the hanger bolt and also sets a minimum engaged thread length which is sufficient to carry the weight of the door panels.

The above described hanger hinge has several advantages, including:

the nut and sleeve assembly allows easy height adjustment of the panels 17, 18;

the nut and sleeve are self-locking to prevent loss of adjustment;

the sleeve 28 conceals the adjustment mechanism, and provides a clean aesthetically pleasing appearance matching the curvature of the knuckle portions of the hinge leaves;

the components can be manufactured economically from common materials, such as stainless steel;

the sleeve and nut arrangement is capable of bearing the load of large heavy door panels.

As an added advantage, the adjustment of the locking nut 22 can be reduced to a single handed operation by locking the hanger bolt 12 to one of the hinge leaves, and hence to the door panel.

Figure 11:
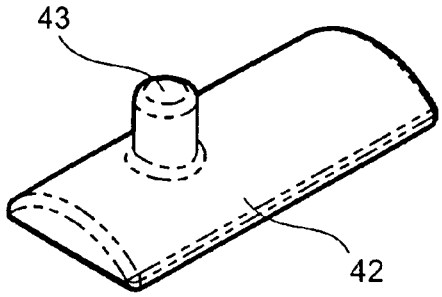
FIG. 11 is a perspective view of a bolt locking member suitable for use with the hanger bolt of FIG. 1.

Such locking is achieved by using a key or locking member 42 as shown in FIG. 11. The locking member 42 has a cross-section matching the removed chord portion of the hanger bolt 12 at its lower end. The locking member 42 also has a radial boss 43 which may be formed integrally thereon, or by a stud or grub screw.

In use, the locking member 42 is inserted in the bore 16 in the knuckle portion 15 of hinge leaf 14, so that the boss 43 locates in a bore or pin hole 44 provided in the knuckle. The locking member 42 is therefore locked rotationally relative to the hinge leaf 14. The hinge leaf 14 is then placed onto the hanger bolt 12, whereupon the locking member 42 locates on the flat surface 21 of the hanger bolt, and serves to lock the hanger bolt 12 rotationally relative to the hinge leaf 14.

Since the hinge leaf 14, and thus the hanger bolt 12 and sleeve 28, are all locked against rotation relative to the door panel, there is no need to hold the sleeve 28 against rotation when adjusting the nut 22. The Allen key 27 may simply be inserted into the nut 22, and rotated to provide the desired adjustment.

Figure 12:
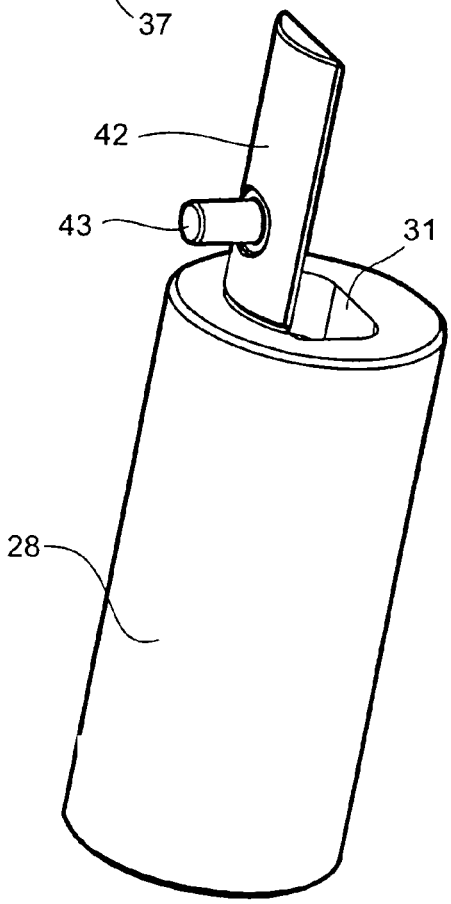
FIG. 12 is a perspective view of the bolt locking member fixed to the sleeve.

Preferably, the locking member 42 may be fixed to the end of, or formed as part of, the sleeve 28 as shown in FIG. 12. This prevents the locking member 42 being lost or inadvertently not inserted.

The foregoing describes only one embodiment of the invention, and modifications which are obvious to those skilled in the art may be made thereto without departing from the scope of the invention as defined in the following claims.

For example, although two axial rebates 25 are shown, a higher number may be provided. This will limit the amount of relative rotation required between the nut and sleeve before the key 36 automatically locks.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A hanger hinge for a folding door, window or similar closure having one or more panels, the hanger hinge comprising:

a hanger bolt having an externally threaded lower end;

a nut member adapted to be threaded onto the threaded end of the hanger bolt, the nut member being a tubular nut having a socket on its underside adapted to receive therein a nut adjusting tool;

a sleeve member having a bore dimensioned to receive the nut member at least partially therein, the sleeve member being supported by the nut member in use and operatively engaging the hanger bolt to prevent relative rotation between the sleeve member and the hanger bolt;

at least one hinge leaf pivotally mounted on the hanger bolt and adapted to be fixed to a respective panel, the operative position of the hinge leaf being dependent on the extent to which the nut member is threaded onto the hanger bolt; and a locking mechanism comprising a radially displaceable mechanical key which releasably locks the nut member rotationally relative to the sleeve member, the locking mechanism being automatically disengaged by axial insertion of the nut adjusting tool to displace the key radially and thereby free the nut member to be rotated relative to the hanger bolt.

2. A hanger hinge as claimed in claim 1, wherein the key is a spring clip.

3. A hanger hinge as claimed in claim 2, wherein the nut member has at least one axial rebate in its lower end and an annular groove on its exterior intermediate its ends, and the sleeve member has an axial keyway in its inner wall at its lower end and an annular groove in its inner wall intermediate its ends, the annular grooves being radially opposed in use, and wherein the spring clip is operatively located in a composite space formed by the opposed annular grooves, and has an arm located in the axial keyway and resiliently engaging the axial rebate on the nut member, the arm being deflected out of engagement with the axial rebate when the nut adjusting tool is inserted in the nut member, to thereby permit the nut member to rotate relative to the sleeve member.

4. A hanger hinge as claimed in claim 1, further comprising a second mechanism for rotationally locking the hanger bolt to the hinge leaf.

5. A hanger hinge as claimed in claim 4, wherein the hanger bolt has a rebate portion thereon, and the second mechanism comprises a key member operatively located between the rebate portion of the hanger bolt and the hinge leaf, and in engagement with the hinge leaf to thereby mechanically lock the hinge leaf against rotation relative to the hanger bolt.

6. A hanger hinge as claimed in claim 5, wherein the key member is fixed to the sleeve member.

7. A hanger hinge as claimed in claim 1, wherein the hanger bolt has an internally threaded lower end, further comprising a wide headed screw for threading into the internally threaded lower end of the hanger bolt.

8. A hanger hinge as claimed in claim 1, further comprising a carriage adapted to travel on a track, the hanger bolt having its upper end connected to the carriage.

9. A nut assembly for use on a hanger hinge having a depending member with a threaded lower end, the nut assembly comprising:

a nut member adapted to be threaded onto the lower end of the depending member, the nut member being a tubular nut having a socket on its underside adapted to receive therein a nut adjusting tool;

a sleeve member having a bore dimensioned to receive the nut member therein, the sleeve member being operatively engageable with the depending member in a rotationally locking relationship; and a locking device for releasably locking the nut member rotationally relative to the sleeve member, the locking device being a mechanical key comprising a spring clip which is automatically disengaged when the nut adjusting tool is inserted into the nut member; wherein the nut member has at least one axial rebate in its lower end and an annular groove on its exterior intermediate its ends, and the sleeve member has an axial keyway in its inner wall at its lower end and an annular groove in its inner wall intermediate its ends, the annular grooves being radially opposed in use, wherein in use, the spring clip is operatively located in a composite space formed by the opposed annular grooves, and has an arm located in the axial keyway and resiliently engaging the axial rebate on the nut member, the arm being deflected radially out of engagement with the axial rebate when a the nut adjusting tool is inserted in the nut member, to thereby permit the nut member to rotate relative to the sleeve member.

10. A hanger hinge for suspending at least one panel from an overhead track, the hanger hinge comprising a carriage adapted to travel on the track, a suspending member operatively depending from the carriage, the suspending member having a threaded lower end;

a nut member adapted to be threaded onto the threaded end of the suspending member, the nut member being a tubular nut having a socket on its underside adapted to receive therein an adjusting tool;

a cover member at least partially surrounding the nut member and operatively engaging the suspending member to prevent relative rotation between the cover member and the suspending member, the cover member being a sleeve having a bore dimensioned to receive the nut member at least partially therein and being supported on the nut member in use;

at least one hinge leaf pivotally mounted on the suspending member and adapted to be fixed to a respective panel, the hinge leaf being supported in use, either directly or indirectly, on the nut member; and a locking mechanism for releaseably locking the nut member rotationally relative to the cover member, the locking mechanism being a radially displaceable spring clip which is automatically disengaged by the adjusting tool when the adjusting tool is inserted into the nut member.

* * * * *